United States Patent [19]

Ciordinik et al.

[11] Patent Number: 4,680,573

[45] Date of Patent: Jul. 14, 1987

[54] INTRUSION WARNING WIRE FENCE

[75] Inventors: Jacques Ciordinik, Bologna; Alessandro Penzo, Crespellano, both of Italy

[73] Assignee: CI.KA.RA S.p.A., Bologna, Italy

[21] Appl. No.: 790,310

[22] Filed: Oct. 22, 1985

Related U.S. Application Data

[63] Continuation of Ser. No. 407,731, Aug. 12, 1982, abandoned.

[30] Foreign Application Priority Data

Aug. 19, 1981 [IT] Italy ..... 12606 A/81

[51] Int. Cl.[4] ..... G08B 13/00; G08B 13/18

[52] U.S. Cl. ..... 340/541; 340/550; 340/555

[58] Field of Search ..... 340/541, 550, 555, 564, 340/652; 256/8, 10–12, 32

[56] References Cited

U.S. PATENT DOCUMENTS

| | | | |
|---|---|---|---|
| 3,725,891 | 4/1973 | Miller | 340/550 |
| 3,803,548 | 4/1974 | Skujins, Jr. | 340/566 |
| 4,155,083 | 5/1979 | Slaats et al. | 340/564 X |
| 4,275,294 | 6/1981 | Davidson | 340/555 X |
| 4,307,386 | 12/1981 | Bridge | 340/555 |
| 4,327,358 | 4/1982 | Karas | 340/541 |

FOREIGN PATENT DOCUMENTS

| | | | |
|---|---|---|---|
| 1114413 | 9/1961 | Fed. Rep. of Germany | 340/550 |
| 2331280 | 6/1977 | France | 256/10 |
| 762686 | 12/1956 | United Kingdom | 256/10 |
| 2039683 | 8/1980 | United Kingdom | 340/550 |
| 2060966 | 5/1981 | United Kingdom . | |
| 2091874 | 8/1982 | United Kingdom | 340/541 |

*Primary Examiner*—James L. Rowland
*Assistant Examiner*—Thomas J. Mullen, Jr.
*Attorney, Agent, or Firm*—King & Schickli

[57] ABSTRACT

The intrusion warning wire fence comprises at least one tubular wire (1, 101), preferably made of metal or of plastics material, glass-fibre reinforced resin, or the like, having the same appearance and, at least apparently, the same mechanical barrier function as the normal wires, or as other normal wires possibly included in the same fence, and loosely containing one or more electrical and/or optical conductors (2), preferably optical fibres, connected to a warning system responsive to any breakage or variation of the conduction capability of said conductors (2). At least one tubular wire (1) containing one or more electrical and/or optical conductors (2) is weakened by means of notches or grooves (3, 4, 5) and/or it is made like a barbed wire (101) by fitting thereon pointed or cutting members (6, 106; 7).

6 Claims, 9 Drawing Figures

INTRUSION WARNING WIRE FENCE

This is a continuation of application Ser. No. 407,731, filed Aug. 12, 1982, now abandoned.

BACKGROUND AND SUMMARY OF THE INVENTION

This invention relates to an intrusion warning wire fence comprising at least one tubular wire which is preferably of metal, or of plastics, glass-fibre reinforced resin, or the like, said tubular wire having substantially the same appearance and, at least apparently, the same mechanical barrier function as the normal wires or as other normal wires possibly included in the same fence, and loosely containing one or more electrical and/or optical conductors, preferably optical fibres, connected to a warning system responsive to any breagage and/or variation of conduction capability of said conductors.

Intrusion warning wires fences of this type have been illustrated in the U.K. Patent Application No. GB-A-2060966.

This invention aims to further increase the protection efficiency of the wire fences of the specified type, and particularly to eliminate any possibility to get over the fence by climbing thereon.

For this purpose, the wire fence described above, according to the invention, is characterized in that at least a tubular wire containing one or more electrical and/or optical conductors is weakened by means of notches or grooves, and/or it is made to look like a barbed wire by arranging suitable barbs thereon.

The weakening notches or grooves in the tubular wire containing the electrical and/or optical conductor or conductors can extend either transversely, circumferentially, or over an arc of the circumference of the tubular wire, or they can extend longitudinally or helically thereon.

The sharp barbs added to obtain the appearance of barbed wire on the tubular wire containing the electrical and/or optical conductor or conductors, can be either conventional wire barbs, or barbed tapes provided with pointed and/or cutting barbs and transversely folded around the tubular wire.

The barbed tubular wires, formed by folding a barbed tape around a tubular wire, may be mechanically weakened by notches or grooves affecting only the thickness of the barbed tape, or both the thickness of the barbed tape and a part of the thickness of the wall of the tubular wire.

According to a further characteristic of the invention, a tubular wire containing the electrical and/or optical conductor(s) and weakened and/or made like barbed wire, is coiled so as to form a concertina wire. Such a concertina wire can be accommodated between two V-arranged arms directed one inwards and the other outwards of the fence, respectively, and arranged on the tops of the poles existing between the individual sections of the fence.

Obviously, said concertina wire of weakened and/or barbed tubular wire containing one or more electrical and/or optical conductors can also be used alone and can constitute by itself the intrusion warning wire fence described in the preamble.

BRIEF DESCRIPTION OF THE DRAWINGS

These and other characteristics of the invention and the advantages resulting therefrom will be apparent from the following description of some embodiments thereof, given by way of non-limitating examples in the accompanying drawings, wherein.

DESCRIPTION OF THE PREFERRED EMBODIMENTS

Figure 1:
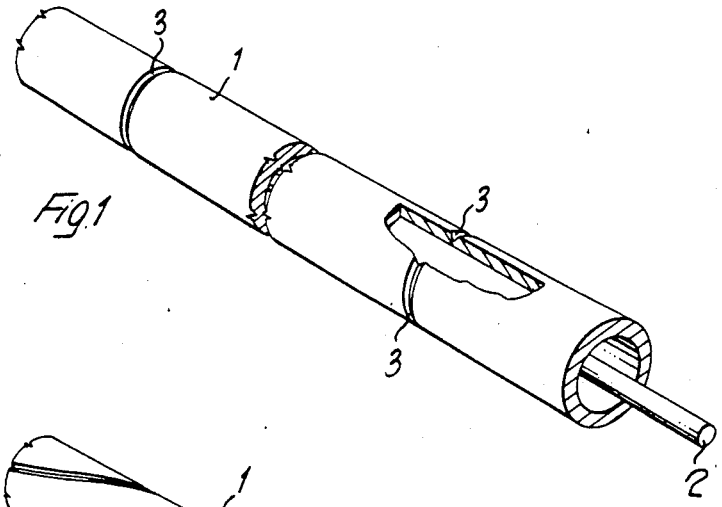
FIGS. 1, 2 and 3 are perspective enlarged view of some tubular wires containing one or more electrical and/or optical conductors and weakened by transverse, helical or longitudinal grooving.
Figure 2:
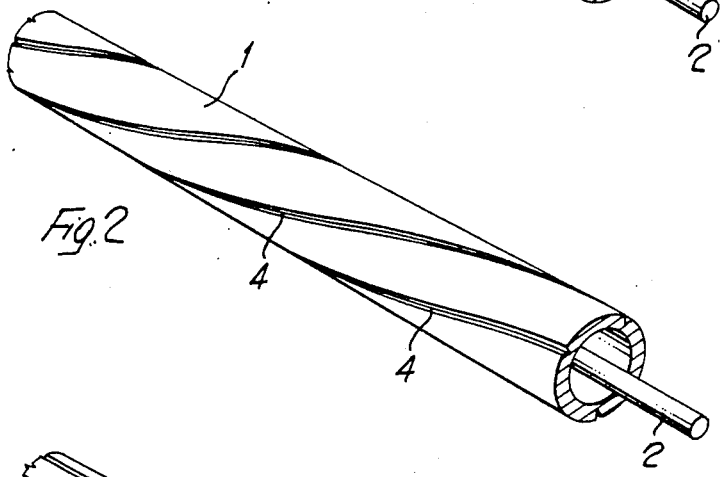
Figure 3:
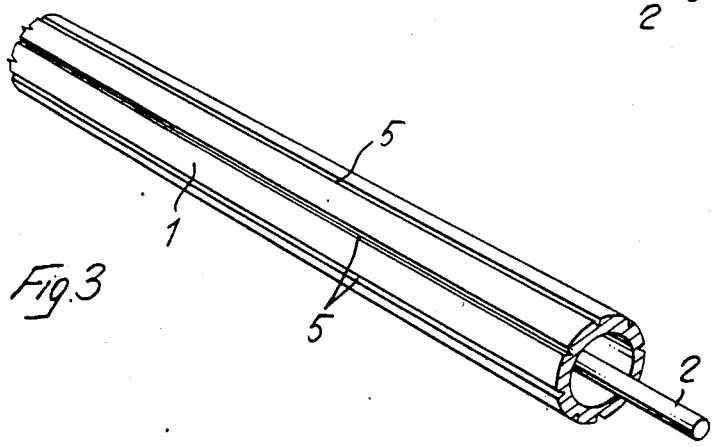

With reference to FIGS. 1 to 3, the invention contemplates a tubular wire 1, which is preferably made of metal, if the case stainless steel, but which can also be made of any suitable plastics material, such as glass-fibre reinforced plastics, and is particularly formed by a small-diametre tube of the so-called BUNDY (Registered Trade Mark) type, obtained by means of one or mroe soldered, welded or glued metal strips. This tubular wire 1 loosely contains within its lumen one or more electrical and/or optical conductors 2, preferably one or more optical-fibre conductors, and is designed particularly to form an intrusion warning wire-lattice of the type described in the U.K. Patent Application No. GB-A-2060966, wherein the electrical and/or optical conductor or conductors 2 in the tubular wires 1 are connected to a warning system which is responsive to rupture and/or distortion, and particularly to stretching and contraction in cross-sectional area (restriction) of the conductor or conductors 2. According to the invention, to avoid that an intruder can step over the wire fence by climbing thereon, at least part of the tubular wires 1 containing the electrical and/or optical conductor or conductors 2 and used to constitute the wire-lattice are mechanically weakened by means of transverse notches or grooves 3 made at suitable space intervals and/or at appropriate locations in the tubular wire 1 and/or at appropriate regions of the fence, as shown in FIG. 1. A similar mechanical weakening of the tubular wires 1 can also be obtained by means of helical grooves or notches 4, as shown in FIG. 2, or by means of longitudinal grooves or notches 5, as shown in FIG. 3. Of course, combinations of two or more types of said notching or grooving, for example of the transverse type 3 in combination with the longitudinal type 5, can be used. The transverse notches or grooves 3 can extend either around the entire circumference of the wire 1 or only over an arc of the circumference thereof.

Generally, the weakening notches or grooves 3, 4, 5 do not extend through the thickness to the inner bore of the tubular wire, and their number, depth, width and/or circumferential or longitudinal extension are selected as a function of the desired weakening effect on the tubular wire 1, so as to obtain an intrusion warning wire-lattice affording a predetermined overall mechanical strength, but at least some weakened tubular wires of the type described above will break more easily when individually subjected to a stress beyond a pre-established limit, and in particular when an intruder tries to climb on the fence to step thereover. When the weakened tubular wires 1 will be broken, the respective electrical and/or optical conductor(s) will also be broken or distorted, so as to produce an alarm indication at the warning indicator.

Figure 4:
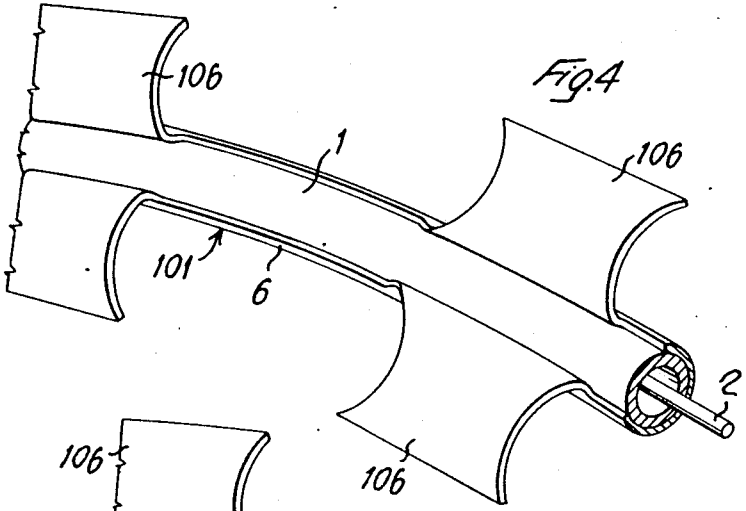
FIG. 4 is a perspective view of a tubular wire containing one or more electrical and/or optical conductors and made like a barbed wire.
Figure 8:
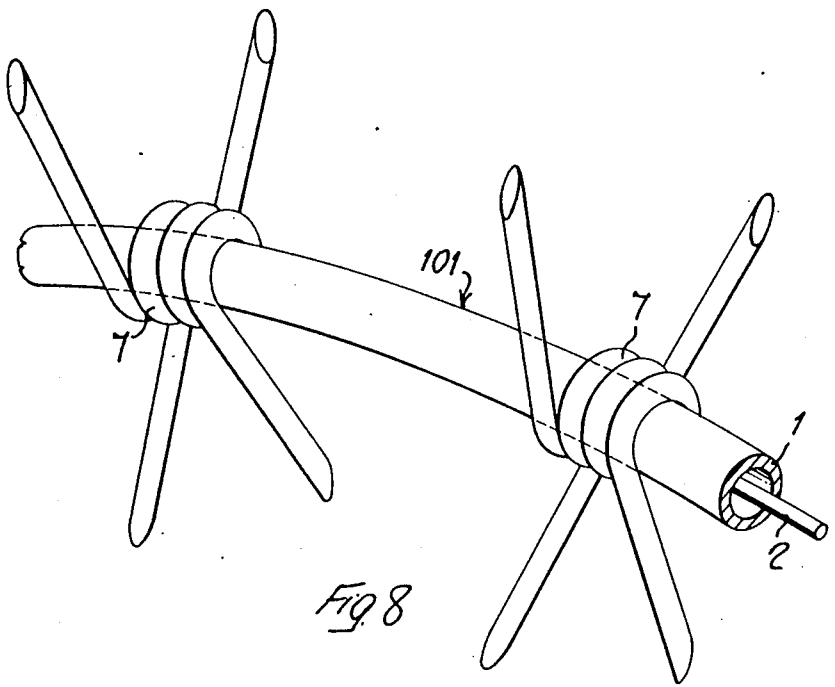
FIG. 8 is a perspective view of another embodiment of a tubular wire containing one or more electrical and/or optical conductors and made like a barbed wire.

With reference to FIGS. 4 and 8, the invention provides also a tubular wire 1, preferably made of metal, if the case of stainless steel, or of suitable plastics material, for example glass-fibre reinforced resin or the like, and formed particularly of a small-diametre tube of the so-called BUNDY type obtained by means of one or more soldered, welded or glued metal strips. This tubular wire also contains, with a loose or free fit therein, one or more electrical and/or optical conductors 2, preferably one or more optical-fibre conductors, and is provided, moreover, according to the invention, with outer pointed and/or cutting projections so as to form a tubular barbed wire 101. This tubular barbed wire 101 can be formed in several ways, for example by folding partly or completely, around a tubular wire 1, a barbed tape 6 provided with projecting wings 106 of any suitable shape having pointed ends or corners and/or cutting edges, as shown in FIG. 4, or by securing, on the outer surface of the tubular wire 1, the wire barbs 7 of the usual barbed wires, as shown in FIG. 8.

The tubular wire 1 containing one or more electrical and/or optical conductors 2 and made like a barbed wire 101, for example as shown in the FIGS. 4 and 8, can be used for any purpose and in any type of fence, in combination with a warning system having the electrical and/or optical conductors 2 connected thereto and responding to rupture, distortion and/or stretching of said conductor or conductors 2. In particular, said barbed tubular wire 101 containing one or more electrical and/or optical conductors 2 can be used in the wire-lattice according to the U.K. Patent Application GB-A-2060966, for example to form one or more inclined upper barriers and/or a concertina barbed wire, as desribed hereinafter, and/or to constitute at least some wires of said wire-lattice.

Figure 6:
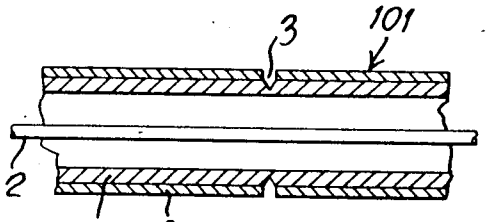
FIGS. 5 and 6 are a perspective and a longitudinal sectional views, respectively, showing one possible weakening of the barbed tubular wire of FIG. 4.
Figure 7:
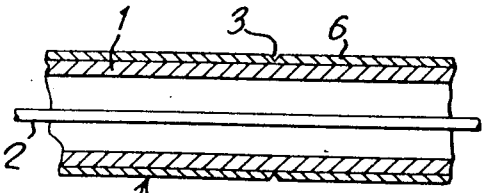
FIG. 7 is a longitudinal sectional view showing another possible weakening of the barbed tubular wire of FIG. 4.
Figure 5:
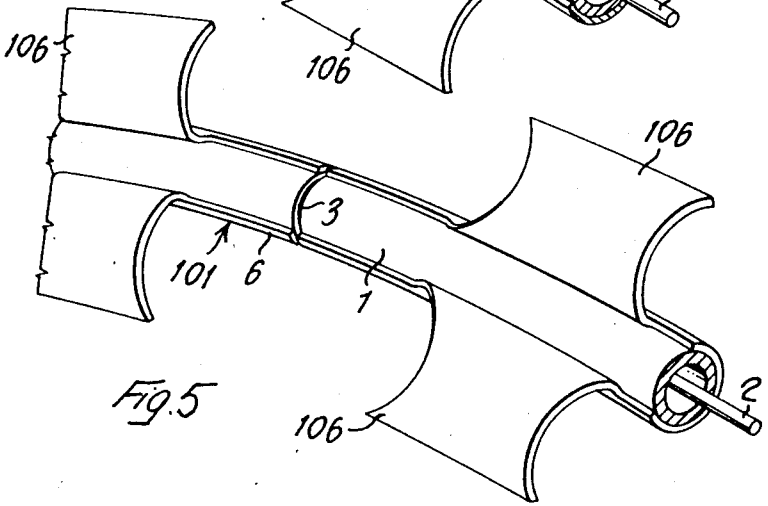

The barbed tubular wires 101 according to FIGS. 4 and 8 can also be weakened as shown in FIGS. 1 to 3. A barbed tubular wire 101 according to FIG. 4 and weakened by transverse notching or grooving 3, is shown in FIG. 5. The transverse notches and grooves 3 of this barbed tubular wire can extend either around the entire circumference of the wire or only over an arc of the circumference thereof, and they can affect only the barbed tape 6 having the pointed and/or cutting barbs 106 without affecting the tubular wire 1, a shown in the longitudinal sectional view of FIG. 7. The depth of the transverse notching or grooving 3 can either extend only for a fraction of the thickness of the barbed tape 6, or can get through said barbed tape 6, with no trouble since said tape 6 is folded around the tubular wire 1 at least partially and is, therefore, secured thereto. In another possible embodiment, the weakening transverse notches or grooves 3 get through the barbed tape 6 and penetrate partly in the thickness of the tubular wire 1, as shown in FIGS. 5 and 6.

Figure 9:
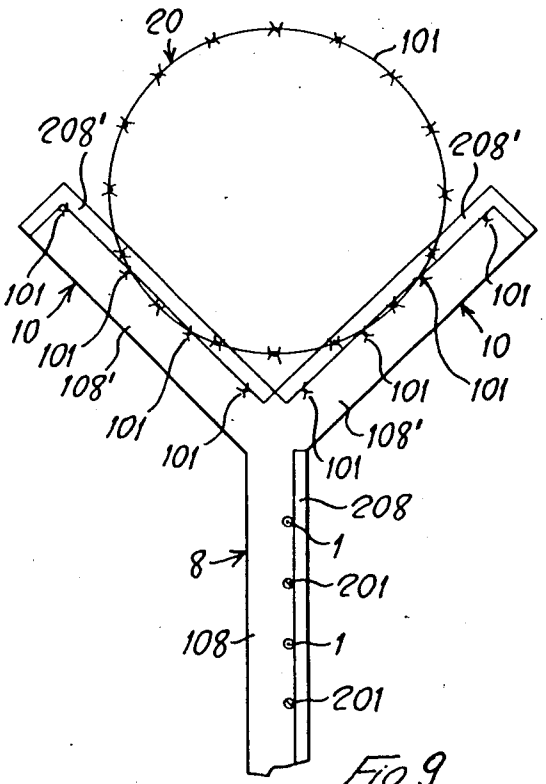
FIG. 9 is an elevational view of a pair of V-arranged arms mounted on the top of a pole of an intrusion warning fence according to the invention and designed to support two inclined barbed wire barriers and/or a concertina wire.

An intrusion warning wire lattice according to the above mentioned Patent Application No. GB-A-2060966 can be formed by individual sections extending between poles 8, preferably of box-type, wherein at least some of the tubular wires 1 terminate, so that the respective electrical and/or optical conductors 2 can be connected to each other in the interior of said poles. With reference to FIG. 9, each box-type post can be formed, for example, by an upright 108 that, in horizontal cross-section, has a U-shaped configuration, the open side of the U-shaped upright being directed toward the fenced area and being closed by a corresponding side cover 208 fitted thereon. Formed in the edge portions of the two side walls of the upright 108, at the open side thereof, are horizontal cutouts spaced from each other at the same spacing as the horizontal tubular wires 1 and non-tubular wires 201 of the two wire-lattice sections associated to a box-type post 8. The horizontal wires 1, 201 of these two sections are inserted into said cutouts and the two sections are then secured to the posts 8 by means of the respective side covers 208, which are fitted and secured to the uprights 108 by any suitable means, preferably so as to be removable therefrom, thereby closing the open side of the U-shaped uprights 108 and respective cutouts.

According to the invention, to prevent an intruder from stepping over the wire fence, each post 8 is provided at the top thereof with at least an angled arm 10 or, preferably, two V-arranged arms 10, one of them being inclined toward the area enclosed by the intrusion-warning fence, and the other being inclined in the opposite direction, as shown in FIG. 9. The inclined arm, or arms, 10 support each a similarly-inclined barrier of wires, preferably barbed wires, of the conventional type or particularly of tubular barbed wires 101 according to the invention, weakened or not and containing one or more electrical and/or optical conductors 2 connected to the warning system. Preferably, the inclined arms 10 are constructed so as to safely support the inclined barrier of wires, for example barbed wires 101, but to break, bend or distort appreciably under the weight of an intruder trying to step over the fence. The breakage or distortion of an inclined arm 10 causes the breakage, distortion or stretching of the wires 101 of the inclined barrier supported by said arms 10 and, therefore, of the respective electrical and/or optical conductors and/or the breakage or distortion of the electrical and/or optical conductors associated with said inclined arms 10 so as to cause the warning system to produce an alarm.

The inclined arm, or arms, 10 on the tops of the poles for the wire fence, and the association thereof to the electrical and/or optical conductors of the warning system can be embodied in any suitable manner. In the embodiment shown in FIG. 9, the two V-arranged arms 10 are of box-type structure and are formed each by a U-shaped channel 108' and a respective cover 208', similarly to the box-type upright 8.

The two V-arranged arms can support, in combination or not with one or more wire barriers 101, a concertina barbed wire 20 comprising conventional barbed wires and/or, at least partly, tubular barbed wires according to the invention, either weakened or not, containing one or more electrical and/or optical conductors 2 connected to the warning system associated with the intrusion warning wire fence.

What is claimed is:

1. An intrusion warning wire fence comprising:

(a) at least one tubular wire helically coiled in the shape of a concertina wire;

(b) at least one energy conductor loosely contained within a lumen of said tubular wire;

(c) a warning system responsive to any variation of conduction capability of said at least one conductor;

(d) notch or groove means extending transversely to and weakening said tubular wire;

(e) barbed means on said tubular wire; and (f) two inclined V-arranged arms for supporting said wire therebetween, said arms being directed inward and outwards of a fence and mounted on tops of posts arranged between sections of said fence.

2. An intrusion warning wire fence according to claim 1, wherein said at least one energy conductor is an optical fiber.

3. An intrusion warning wire fence according to claim 1, wherein the tubular wire is barbed by means of separate wire barbs.

4. An intrusion warning wire fence according to claim 1, wherein the tubular wire is barbed by means of a barbed tape folded around said tubular wire.

5. An intrusion warning wire fence according to claim 4, wherein the tubular wire is weakened by means of notches or grooves extending within the thickness of the barbed tape.

6. An intrusion warning wire fence according to claim 4, wherein the tubular wire is weakened by means of notches or grooves penetrating through the entire thickness of the barbed tape and partially in the thickness of the wall of the tubular wire.

* * * * *